US009945240B2

(12) United States Patent
Grant et al.

(10) Patent No.: US 9,945,240 B2
(45) Date of Patent: Apr. 17, 2018

(54) POWER TURBINE HEAT SHIELD ARCHITECTURE

(71) Applicant: PW POWER SYSTEMS, INC., Glastonbury, CT (US)

(72) Inventors: Fernando K Grant, South Windsor, CT (US); Fabian D. Betancourt, Meriden, CT (US); John J Korzendorfer, Glastonbury, CT (US); Andrew P Boursy, Marlborough, CT (US); Alexander Sankovich, Hebron, CT (US); Henry K Webster, Jupiter, FL (US); Christopher W Moore, Ellington, CT (US); Charles C Wu, Glastonbury, CT (US)

(73) Assignee: PW POWER SYSTEMS, INC., Glastonbury, CT (US)

( * ) Notice: Subject to any disclaimer, the term of this patent is extended or adjusted under 35 U.S.C. 154(b) by 532 days.

(21) Appl. No.: 14/512,523

(22) Filed: Oct. 13, 2014

(65) Prior Publication Data

US 2016/0102568 A1 Apr. 14, 2016

(51) Int. Cl.

| | |
|---|---|
| ***F01D 9/06*** | (2006.01) |
| ***F01D 25/12*** | (2006.01) |
| ***F01D 9/04*** | (2006.01) |
| ***F01D 11/00*** | (2006.01) |
| ***F01D 25/24*** | (2006.01) |

(52) U.S. Cl.

CPC ..... *F01D 9/065* (2013.01); *F01D 9/042* (2013.01); *F01D 11/005* (2013.01); *F01D 25/12* (2013.01); *F01D 25/246* (2013.01)

(58) Field of Classification Search

CPC ..... F01D 9/042; F01D 9/065; F01D 11/005; F01D 25/12; F01D 25/125; F01D 25/162; F01D 25/246

See application file for complete search history.

(56) References Cited

U.S. PATENT DOCUMENTS

| | | | | |
|---|---|---|---|---|
| 4,053,189 A * | 10/1977 | Novotny | F01D 25/162 384/476 |
| 4,271,666 A * | 6/1981 | Hurley | F02K 1/825 415/116 |
| 2013/0115057 A1* | 5/2013 | Suciu | F01D 25/162 415/170.1 |
| 2016/0237854 A1* | 8/2016 | Grant | F02C 7/24 |

FOREIGN PATENT DOCUMENTS

WO WO2014052007 * 4/2014

* cited by examiner

*Primary Examiner* — Woody Lee, Jr.
*Assistant Examiner* — Brian O Peters
(74) *Attorney, Agent, or Firm* — Schwegman Lundberg & Woessner, P.A.

(57) ABSTRACT

A power turbine section for a gas turbine engine includes a heat shield assembly mounted to a bearing support, the heat shield assembly forms an outer diameter directed toward an inner vane platform of the power turbine vane array.

21 Claims, 13 Drawing Sheets

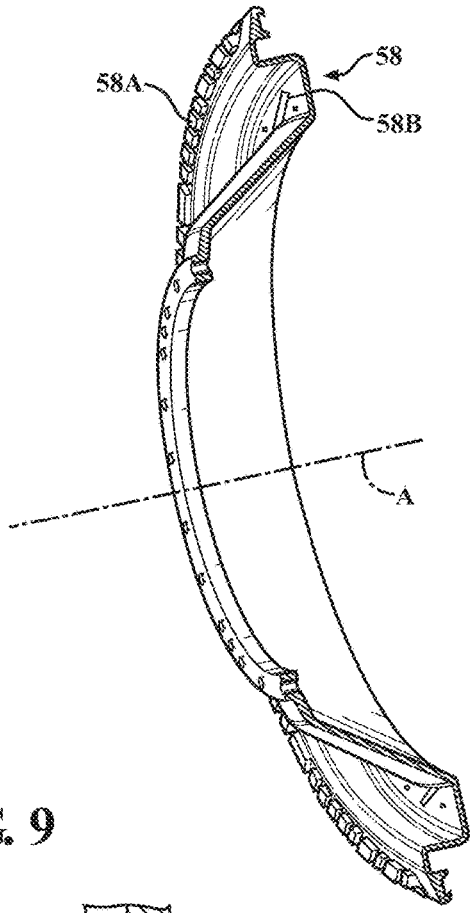
FIG. 8
FIG. 9
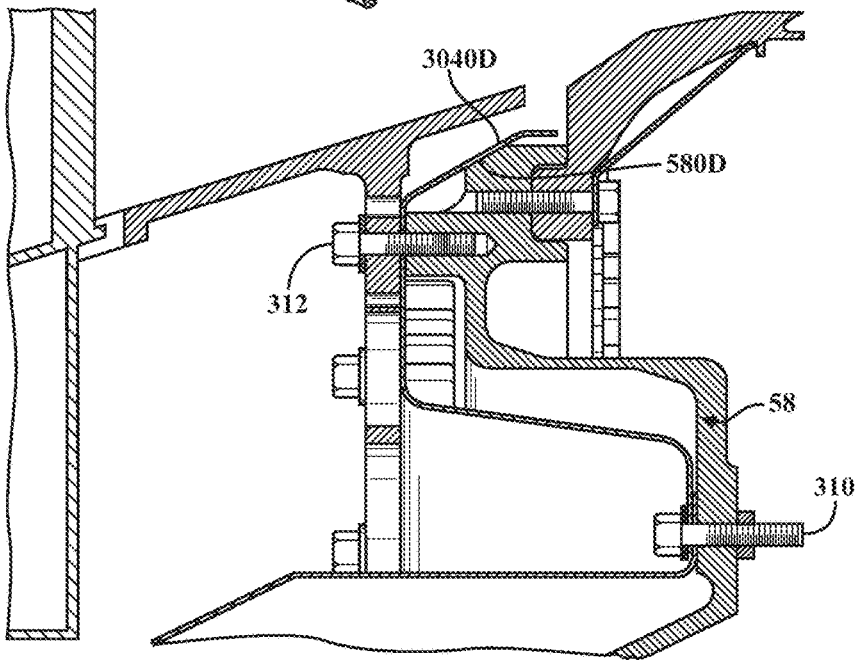

POWER TURBINE HEAT SHIELD ARCHITECTURE

BACKGROUND

The present disclosure relates to a gas turbine engine and, more particularly, to a power turbine section therefor.

In a gas turbine engine, such as a large frame heavy-duty industrial gas turbine (IGT) engine, a core gas stream generated in a gas generator section is passed through a power turbine section to produce mechanical work. The power turbine includes one or more rows, or stages, of stator vanes and rotor blades that react with the core gas stream to drive a generator or other system.

Interaction of the core gas stream with the power turbine hardware may result in the hardware being subjected to temperatures beyond the design points. Over time, such temperatures may reduce the life of the power turbine at the junction between the gas generator section and the power turbine section.

SUMMARY

A power turbine section for a gas turbine engine according to one disclosed non-limiting embodiment of the present disclosure includes a bearing support and a heat shield assembly mounted to the bearing support, the heat shield assembly forms an outer diameter directed toward an inner vane platform of a power turbine vane array.

A further embodiment of the present disclosure includes, wherein the heat shield assembly forms a conic shaped inner diameter between a first multiple of fastener apertures and a second multiple of fastener apertures.

A further embodiment of any of the foregoing embodiments of the present disclosure includes, wherein the heat shield assembly forms an L-shaped inner diameter between a first multiple of fastener apertures and a second multiple of fastener apertures.

A further embodiment of any of the foregoing embodiments of the present disclosure includes, wherein the heat shield assembly forms an S-shaped inner diameter between a first multiple of fastener apertures and a second multiple of fastener apertures.

A further embodiment of any of the foregoing embodiments of the present disclosure includes, wherein the heat shield assembly forms a sine-wave shaped inner diameter between a first multiple of fastener apertures and a second multiple of fastener apertures.

A further embodiment of any of the foregoing embodiments of the present disclosure includes, wherein the heat shield assembly includes an outer heat shield with an inner portion, an outer portion, and a finger seal therebetween, the finger seal disposed between a first multiple of fastener apertures and a second multiple of fastener apertures.

A further embodiment of any of the foregoing embodiments of the present disclosure includes, wherein the outer diameter includes more than one bend.

A further embodiment of any of the foregoing embodiments of the present disclosure includes, wherein the outer diameter includes a press fit interface with an outer diameter of the bearing support.

A further embodiment of any of the foregoing embodiments of the present disclosure includes, wherein the outer diameter includes a press fit interface with an inlet duct, the inlet duct at least partially supported by the bearing support.

A further embodiment of any of the foregoing embodiments of the present disclosure includes, wherein an aft end section of the heat shield extends aft of the inlet duct.

A further embodiment of any of the foregoing embodiments of the present disclosure includes, wherein an aft end section of the heat shield fills a gap between an aft edge of the inlet duct and the inner vane platform.

A further embodiment of any of the foregoing embodiments of the present disclosure includes, wherein the aft end section of the heat shield forms a ramp surface that extends an inner surface of the inlet duct.

A further embodiment of any of the foregoing embodiments of the present disclosure includes, wherein the aft end section of the heat shield forms an arcuate bend within the gap.

A further embodiment of any of the foregoing embodiments of the present disclosure includes, wherein an aft end section of the heat shield extends aft of the inlet duct and into contact with the inner vane platform.

A further embodiment of any of the foregoing embodiments of the present disclosure includes, wherein the aft end section of the heat shield is displaced from the inner vane platform.

A power turbine section for a gas turbine engine according to another disclosed non-limiting embodiment of the present disclosure includes an inlet case along an axis; a power turbine vane array mounted to the inlet case; a bearing support mounted to the power turbine vane array; and a heat shield assembly mounted to the bearing support, the heat shield assembly includes an inner heat shield and an outer heat shield, the outer heat shield including a first multiple of fastener apertures and a second multiple of fastener apertures, the outer heat shield including an outer diameter radially outboard of the first multiple of fastener apertures, the outer diameter directed toward an inner vane platform of the power turbine vane array.

A further embodiment of any of the foregoing embodiments of the present disclosure includes, wherein the outer diameter includes a press fit interface with an outer diameter of the bearing support.

A further embodiment of any of the foregoing embodiments of the present disclosure includes, wherein the outer diameter includes a press fit interface with an inlet duct, the inlet duct at least partially supported by the bearing support.

A further embodiment of any of the foregoing embodiments of the present disclosure includes, wherein the outer diameter includes a press fit interface with the inner vane platform.

A further embodiment of any of the foregoing embodiments of the present disclosure includes, wherein the heat shield assembly includes a first multiple of fastener apertures and a second multiple of fastener apertures, at least one of the multiple of fastener apertures includes a slot therefrom.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows:

FIG. 8 is a sectional view of an outer diameter heat shield according to another disclosed non-limiting embodiment;

FIG. 9 is a sectional view of an outer diameter heat shield according to another disclosed non-limiting embodiment;

DETAILED DESCRIPTION

Figure 1:
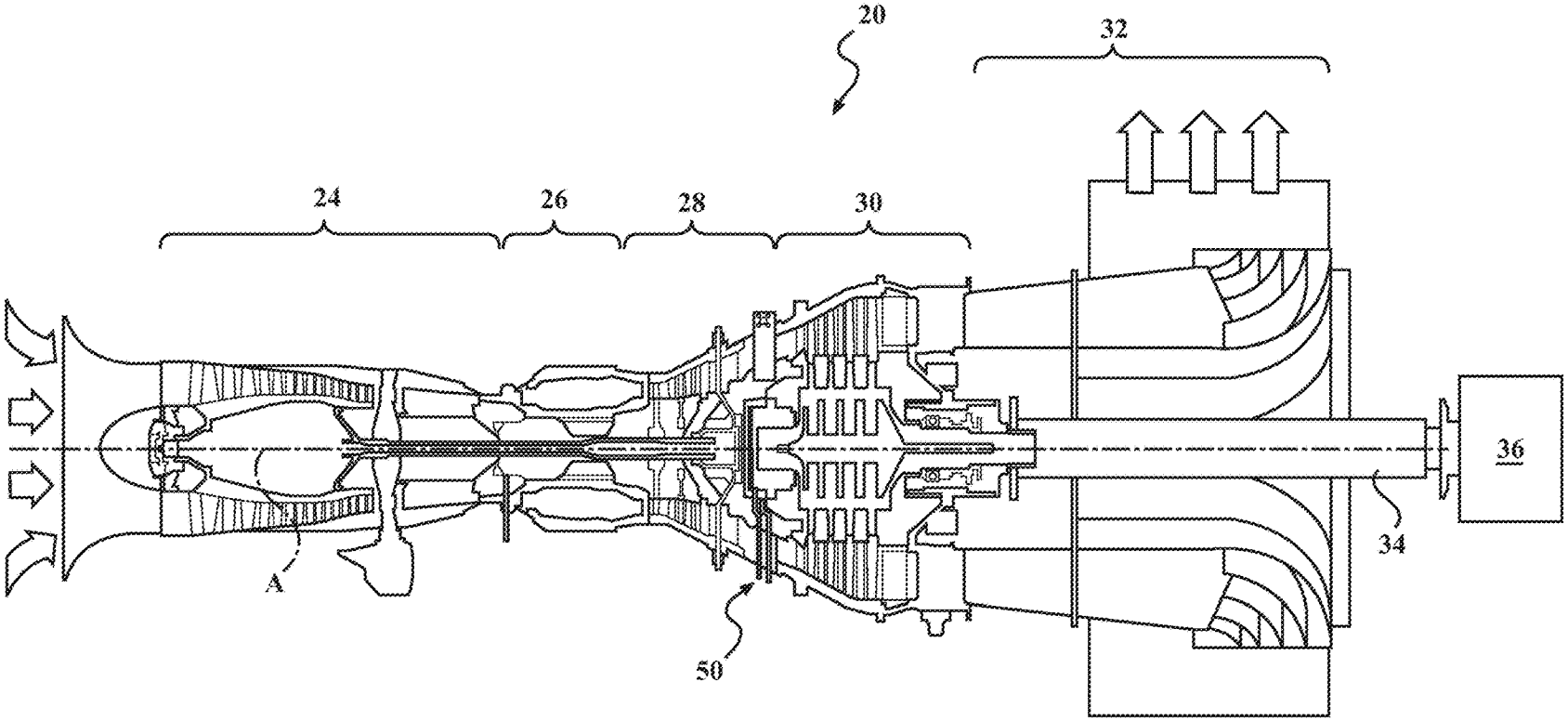
FIG. 1 is a schematic view of an example gas turbine engine architecture.
Figure 2:
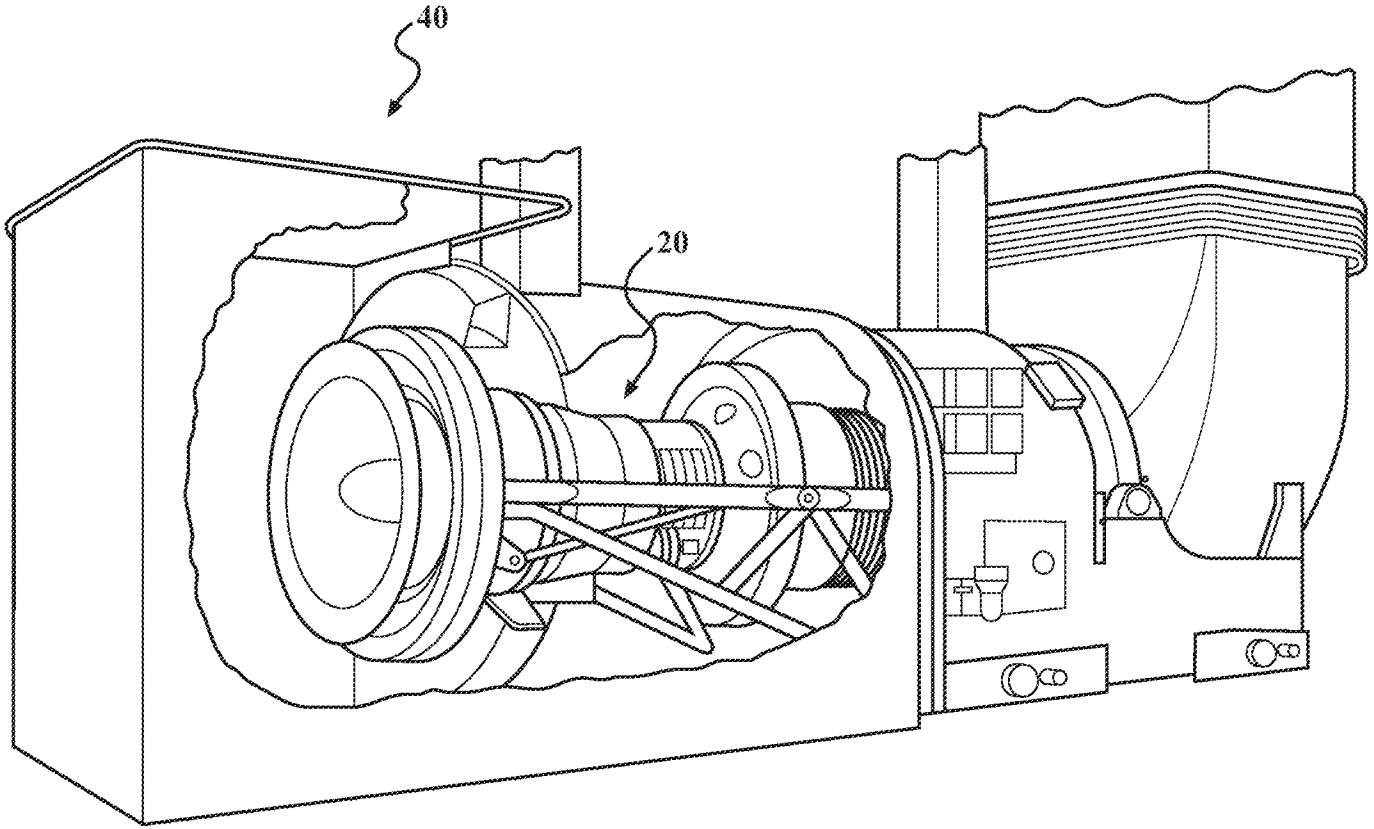
FIG. 2 is a schematic view of an example gas turbine engine in an industrial gas turbine environment.

FIG. 1 schematically illustrates a gas turbine engine 20. The gas turbine engine 20 generally includes a compressor section 24, a combustor section 26, a turbine section 28, a power turbine section 30, and an exhaust section 32. The engine 20 may be situated within a ground mounted enclosure 40 (FIG. 2) typical of an industrial gas turbine (IGT). Although depicted as specific engine architecture in the disclosed non-limiting embodiment, it should be understood that the concepts described herein are not limited to only such architecture, as the teachings may be applied to other gas turbine architectures.

Figure 3:
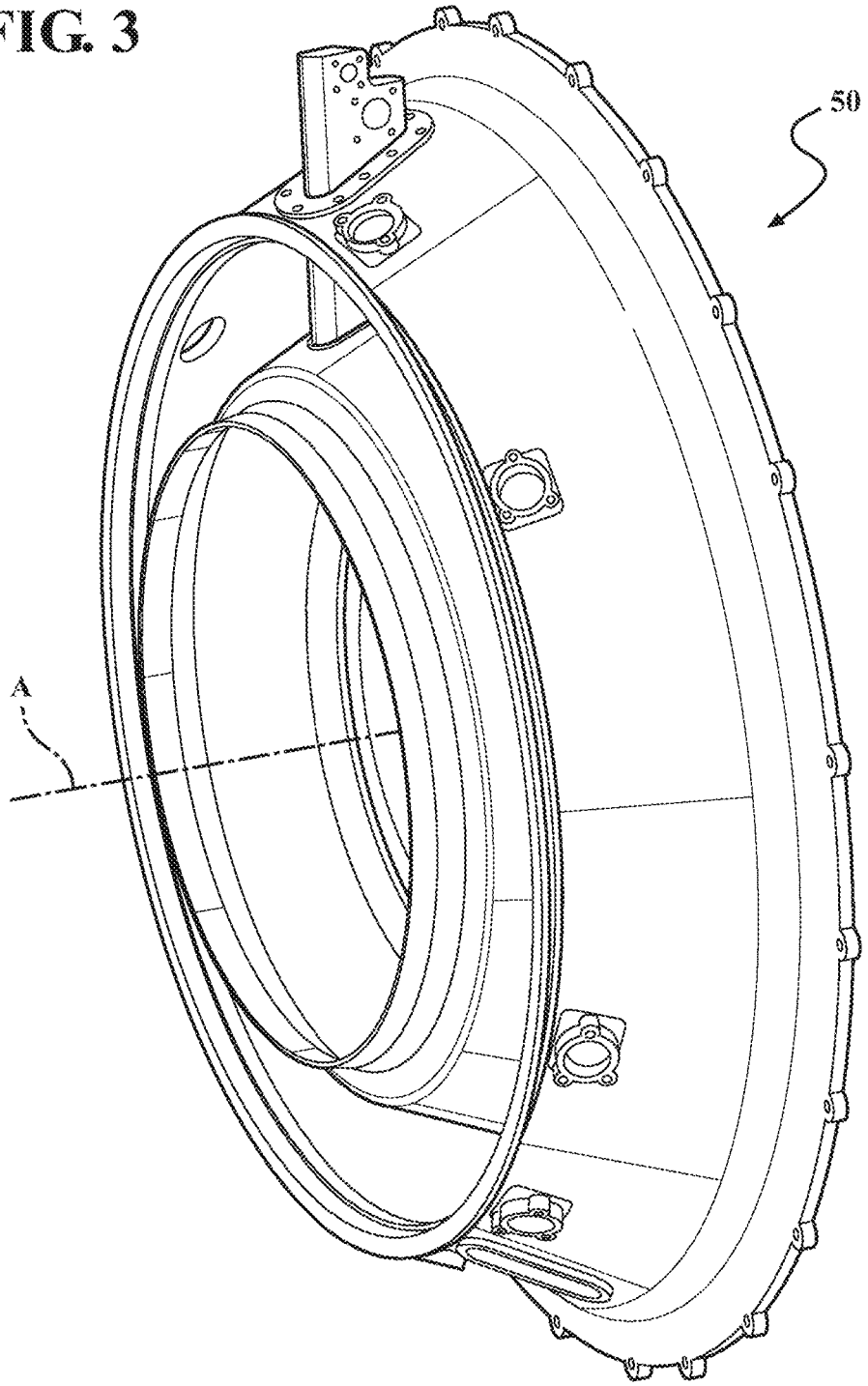
FIG. 3 is a perspective view of a power turbine inlet.

The compressor section 24, the combustor section 26, and the turbine section 28 is commonly referred to as a gas generator section to drive the power turbine section 30. The power turbine section 30 drives an output shaft 34 to power a generator 36 or other system. The power turbine section 30 generally includes a power turbine inlet 50 (FIG. 3) that communicates the core gas stream from the turbine section 28 of the gas generator into the one or more rows, or stages, of stator vanes and rotor blades. In one disclosed non-limiting embodiment, the power turbine section 30 includes a free turbine with no physical connection between the gas generator section and the power turbine section 30. The generated power is a thereby a result of mass flow capture by the otherwise free power turbine.

Figure 4:
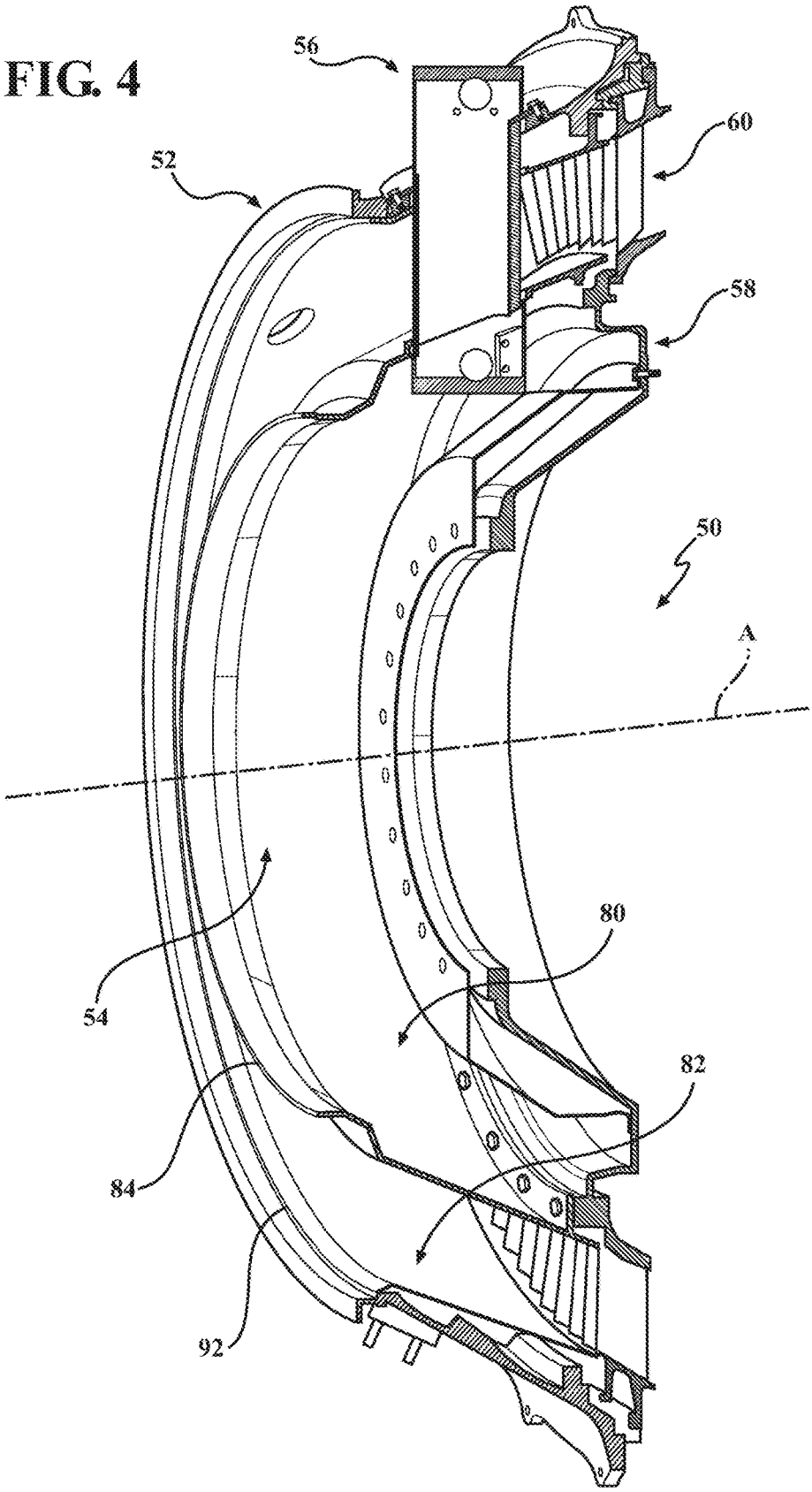
FIG. 4 is a schematic sectional view of power turbine inlet.

With reference to FIG. 4, the power turbine inlet 50 generally includes an inlet case 52, an inlet duct 54, an air strut 56, a bearing support 58, and a first power turbine vane array 60. The inlet duct 54 is mounted to the inlet case 52 and the bearing support 58 to guide the core gas stream to the first power turbine vane array 60 mounted between the inlet case 52 and the bearing support 58. The engine 20 generally includes a multiple of bearing supports 58 to support the rotational hardware for rotation about an engine central longitudinal axis A. In this disclosed non-limiting embodiment, the bearing support 58, in the power turbine inlet 50 is the #7 bearing support in the engine 20.

Figure 5:
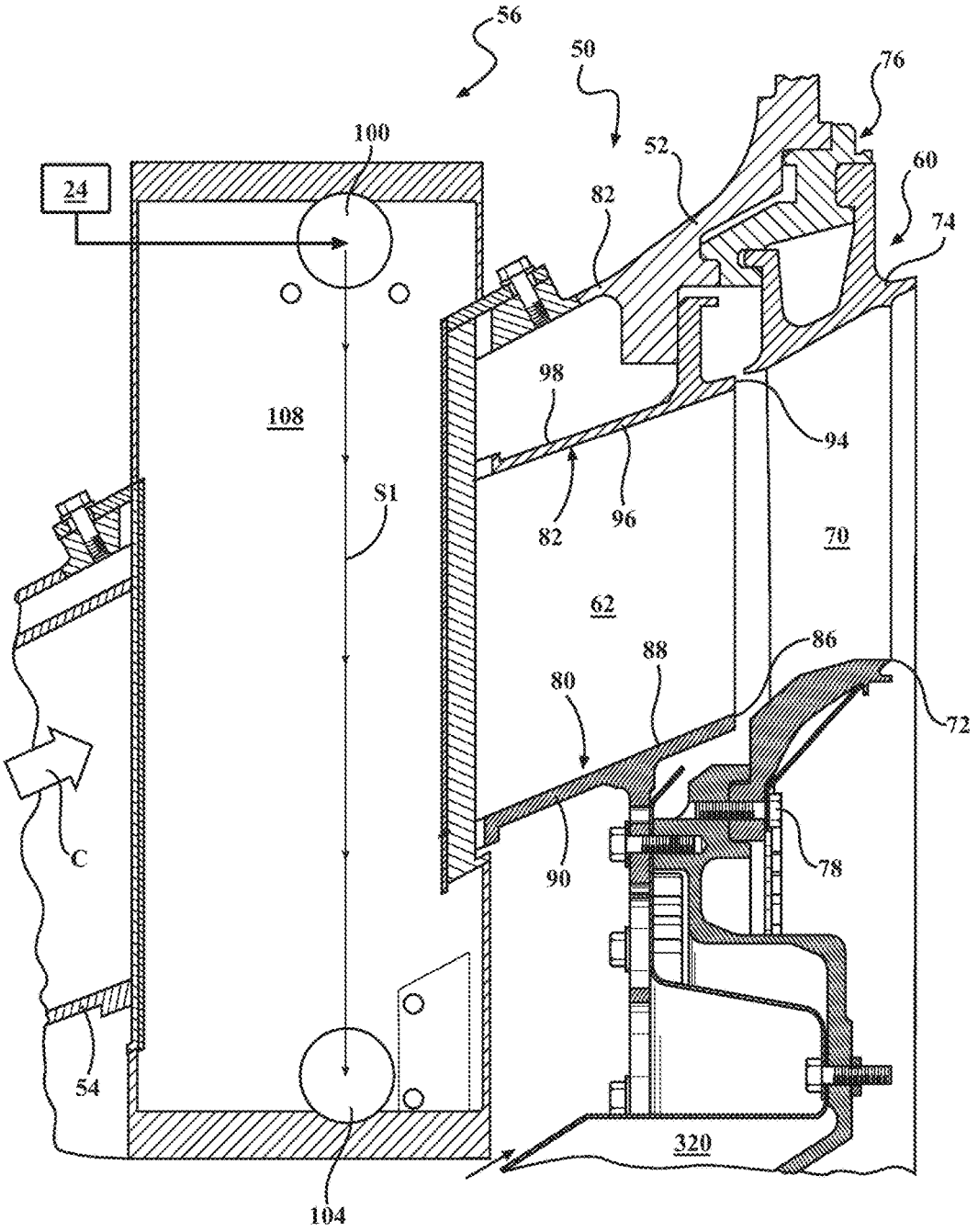
FIG. 5 is an expanded schematic sectional view of the power turbine inlet.

With reference to FIG. 5, the first power turbine vane array 60 generally includes an array of airfoils 70 that extend between a respective inner vane platform 72 and an outer vane platform 74. The outer vane platforms 74 may be mounted to the inlet case 52 via a hook and lug arrangement 76 and the inner vane platform 72 may be mounted to the bearing support 58 via fasteners 78 such as bolts. The respective inner vane platform 72 and the outer vane platform 74 at least partially bound a core gas path flow "C" along a core gas path 62. The air strut 56 communicates a secondary cooling airflow "S1" and "S2" from, for example, a multiple of stages the compressor section 24 to cool hardware within and around the core gas path 62.

The inlet duct 54 generally includes an annular inner duct wall 80 and an annular outer duct wall 82. The annular inner duct wall 80 includes an upstream edge 84 (shown in FIG. 4), a downstream edge 86, a gas path surface 88, and a non-gas path surface 90. The annular outer wall 82 includes an upstream edge 92 (shown in FIG. 4), a downstream edge 94, a gas path surface 96, and a non-gas path surface 98. The upstream edges 84, 92 are radially inboard of the respective downstream edges 86, 94 such that the inlet duct 54 generally forms a frustoconical shape (best seen in FIGS. 3 and 4).

The air strut 56 extends through the inlet duct 54 aft of the upstream edges 84, 92 and forward of the downstream edges 86, 94. The downstream edges 86, 94 are upstream of the respective inner vane platform 72 and the outer vane platform 74. The annular inner duct wall 80 and the annular outer duct wall 82 are spaced to generally correspond with the span of the airfoils 70.

Figure 6:
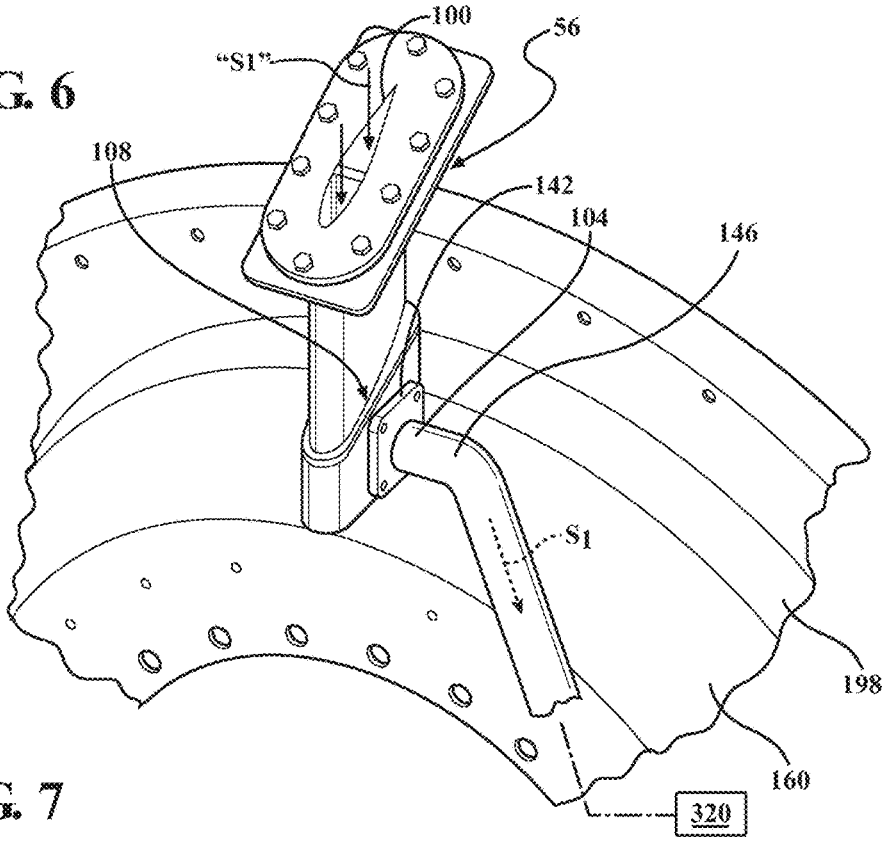
FIG. 6 is a perspective view of an air strut connected to the power turbine inlet.

The air strut 56 generally includes a first inlet 100, a first outlet 104 and a passage 108, therebetween, to communicate a cooling fluid from, for example, the compressor 24, into desired locations of the power turbine 30 (FIG. 6).

With reference to FIG. 6, the first outlet 104 communicates the airflow "S1" into compartment 320 within the power turbine 30. A flange 142 is mounted to the air strut 56 to communicate airflow through conduit 146 and into compartment 320.

Figure 7:
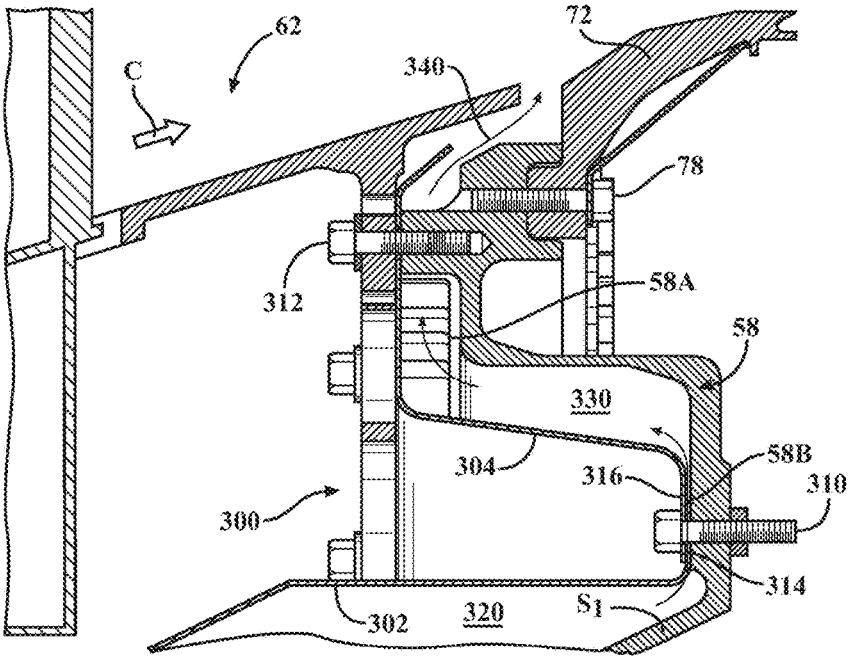
FIG. 7 is a sectional view of an outer diameter heat shield according to another disclosed non-limiting embodiment.

With reference to FIG. 7, a heat shield assembly 300, according to one disclosed non-limiting embodiment, at least partially thermally protects the bearing support 58 from the high temperature of the core gas flow C. The heat shield assembly 300 generally includes an inner heat shield 302 and an outer heat shield 304. As can be seen in FIG. 7, the outer heat shield 304 includes an inner diameter portion proximate the fasteners 310 and an outer diameter portion proximate the fasteners 312. The outer diameter portion can be positioned between the inlet duct 54 and the inner vane platform 72 of the power turbine vane array 60. For example, the outer diameter portion can be positioned axially between coupling flanges of the inlet duct 54 and the inner vane platform 72 to be directed toward and face unobstructedly a leading edge of the inner vane platform 72, as shown in FIGS. 7, 9 and 11-21.

The heat shield assembly 300 is mounted to the bearing support 58 via fasteners 310, 312. The fasteners 310 secure an outer diameter flange 314 of the inner heat shield 302, and an inner diameter flange 316 of the outer heat shield 304. The heat shield assembly 300 is shaped to radially communicate the cooling air from a cavity 320, to a cavity 330, thence to cavity 340. Cavity 320 is radially inboard of cavity 330, which is radially inboard of cavity 340. Cavity 330 is in fluid communication with cavity 340 via slots 58A (FIG. 8) in the bearing support 58. Cavity 320 is in fluid communication with cavity 330 via slots 58B (FIG. 8) in the bearing support 58. The cavity 340 is in fluid communication with the core gas path flow "C" within the core gas path 62. The core gas path flow "C" within the core gas path 62 is thereby purged from the cavity 340 by the cooling airflow S2 to reduce thermal conflict between the power turbine vane array 60 and the bearing support 58 that may otherwise cause cracks in these components.

Figure 10:
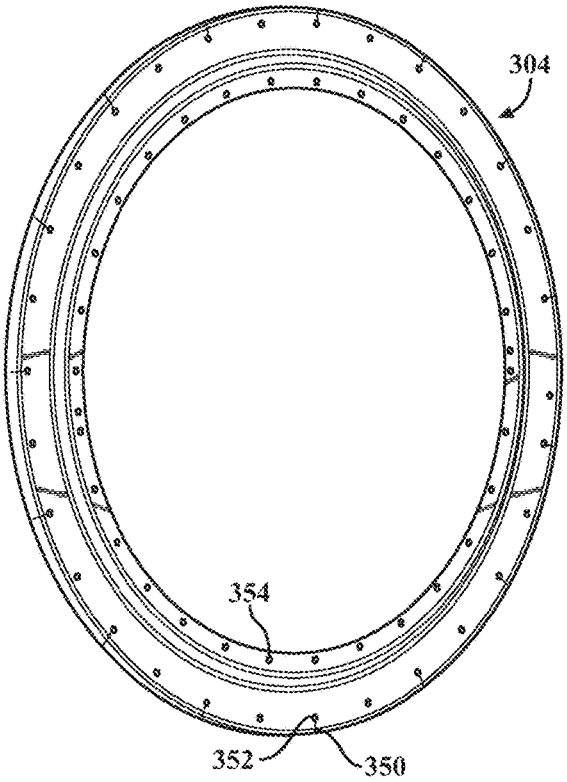
FIG. 10 is a sectional view of an outer diameter heat shield according to another disclosed non-limiting embodiment.

With reference to FIG. 9, in another disclosed non-limitation embodiment, an outer portion 304OD of the heat shield 304 is fitted against an outer portion 58OD of the bearing support 58 to provide damping and reduce vibratory stress. In another disclosed non-limiting embodiment, radial slots 350 (FIG. 10) extend from at least some of a multiple of apertures 352 that receive the fasteners 312, to reduce hoop stress. The multiple of apertures 352 are radially outboard a multiple of apertures 354 that receive the fasteners 310 (FIGS. 9 and 10).

Figure 11:
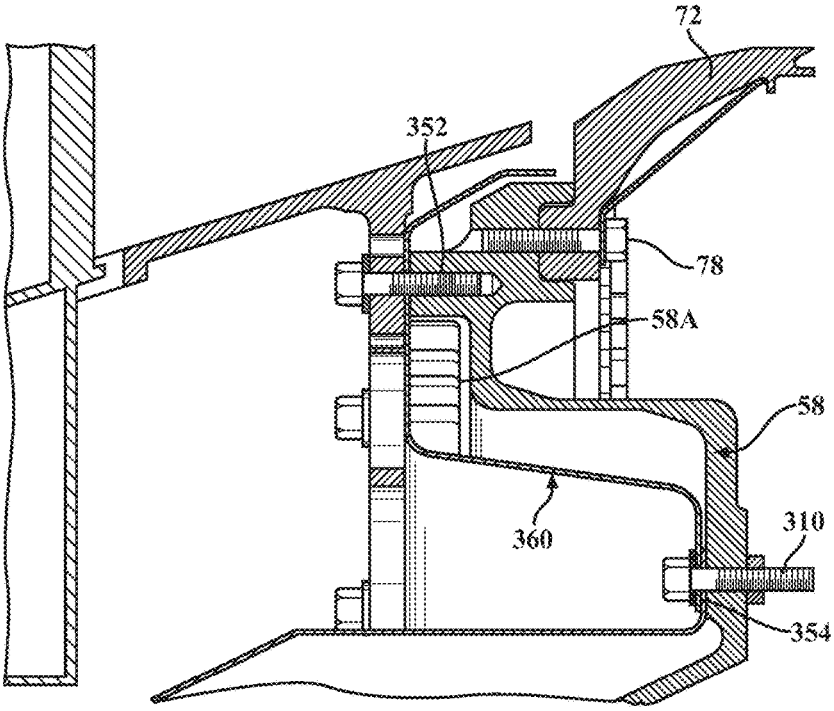
FIG. 11 is a sectional view of an outer diameter heat shield according to another disclosed non-limiting embodiment.

With reference to FIG. 11, in another disclosed non-limiting embodiment, the heat shield 304 includes a conic shaped inner diameter 360 that accommodates thermal expansion of the bearing support 58 to provide some stress relief within the heat shield 304 in response to the bearing support 58 thermal expansion. The inner diameter 360 is located generally between the multiple of apertures 352, 354.

Figure 12:
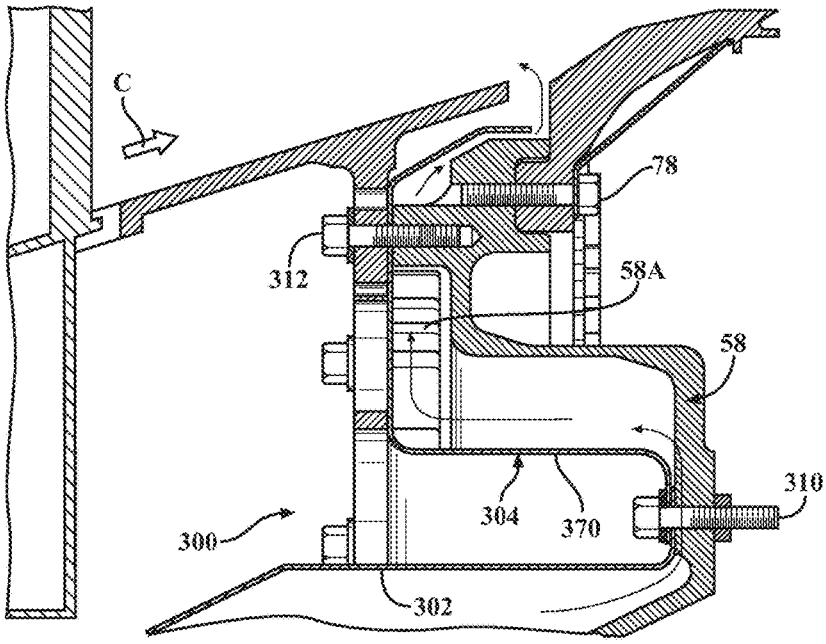
FIG. 12 is a sectional view of an outer diameter heat shield according to another disclosed non-limiting embodiment.

With reference to FIG. 12, in another disclosed non-limiting embodiment, the heat shield 304 includes an L-shaped inner diameter 370 that accommodates thermal expansion of the bearing support 58 to provide stress relief within the heat shield 304 in response to the bearing support 58 thermal expansion, and can be utilized to install fittings and provide another path to route cooling air to the outer diameter of the bearing support 58.

Figure 13:
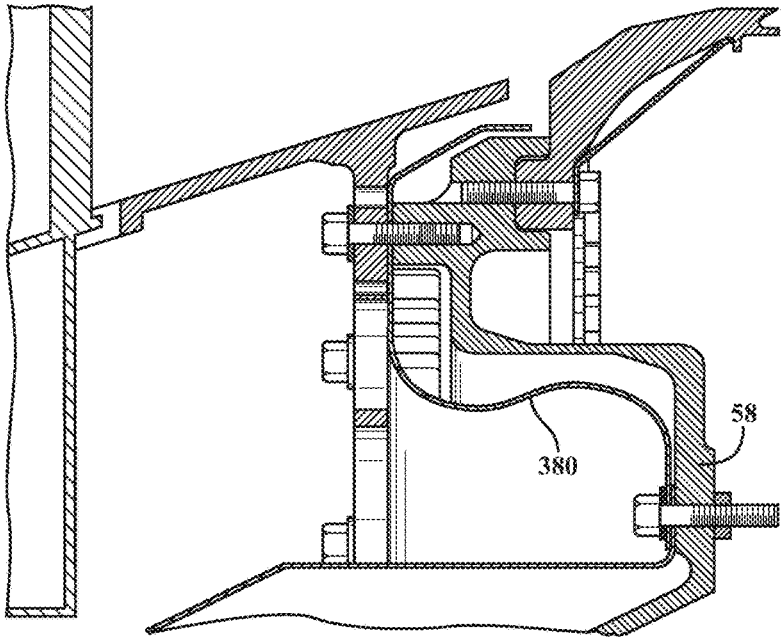
FIG. 13 is a sectional view of an outer diameter heat shield according to another disclosed non-limiting embodiment.

With reference to FIG. 13, in another disclosed non-limiting embodiment, the heat shield 304 includes an S-shaped inner diameter 380 that accommodates thermal expansion of the bearing support 58 to provide stress relief within the heat shield 304 in response to the bearing support 58 thermal expansion.

Figure 14:
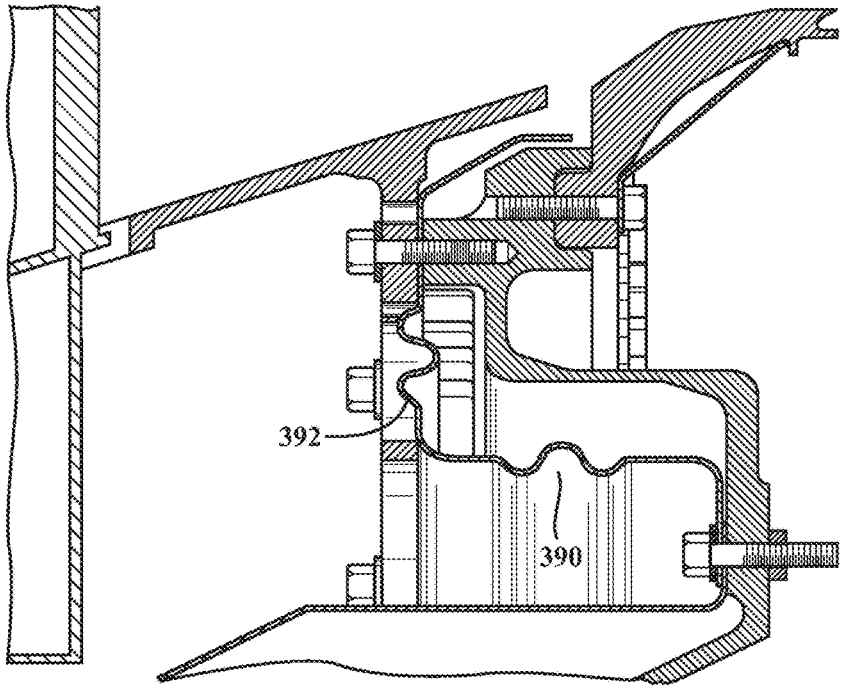
FIG. 14 is a sectional view of an outer diameter heat shield according to another disclosed non-limiting embodiment.

With reference to FIG. 14, in another disclosed non-limiting embodiment, the heat shield 304 includes a sine-wave-shaped inner diameter 390 that accommodates thermal expansion of the bearing support 58 to provide stress relief within the heat shield 304 in response to the bearing support 58 thermal expansion. Alternatively or additionally, a sine-wave-shape may be located along a radial portion 392 of the heat shield 304 as well to provide still further stress relief.

Figure 15:
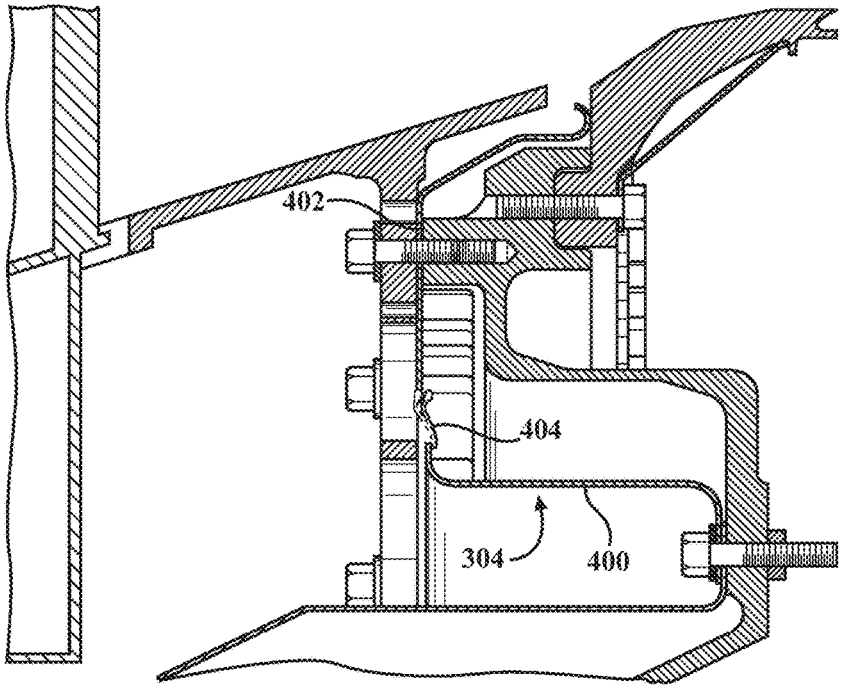
FIG. 15 is a sectional view of an outer diameter heat shield according to another disclosed non-limiting embodiment.

With reference to FIG. 15, in another disclosed non-limiting embodiment, the heat shield 304 includes an inner portion 400, and an outer portion 402 with a finger seal 404 therebetween. The finger seal 404 accommodates relative displacement between the portions 402 and thereby provides significant hoop stress relief.

Figure 16:
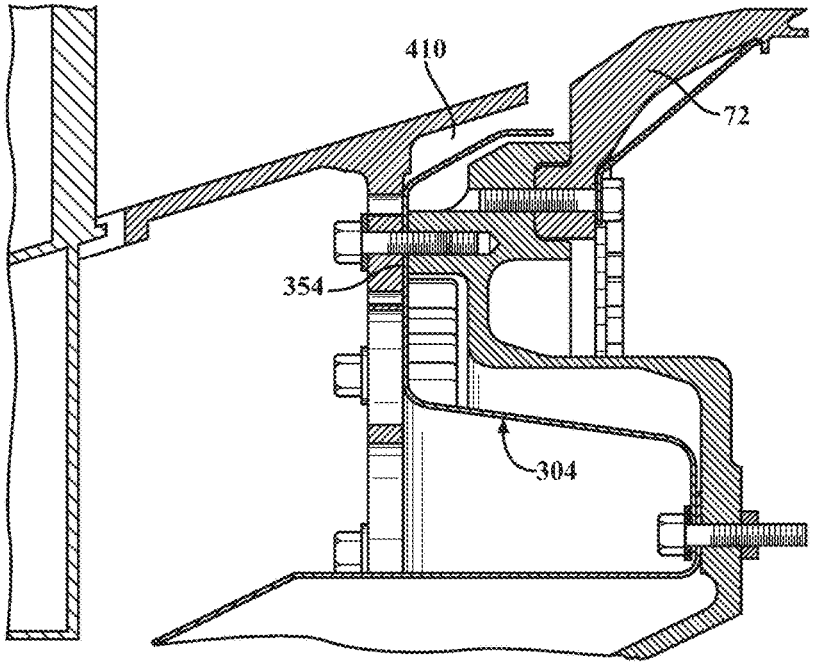
FIG. 16 is a sectional view of an outer diameter heat shield according to another disclosed non-limiting embodiment.

With reference to FIG. 16, in another disclosed non-limiting embodiment, the heat shield 304 includes an outer diameter 410 that is bent toward the inner vane platform 72 to direct the cooling airflow and provide for ease of manufacture. The outer diameter 410 is located generally radially outboard of the multiple of apertures 354.

Figure 17:
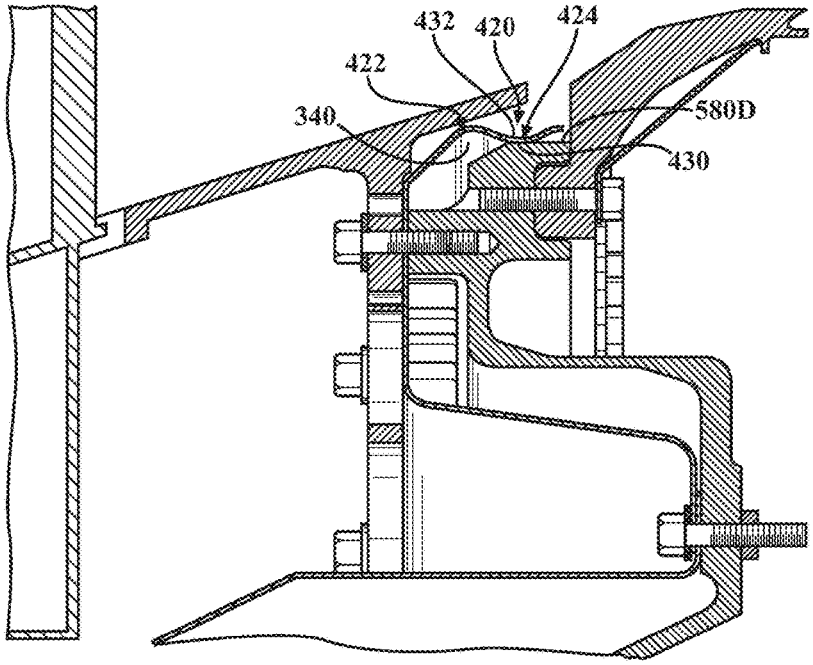
FIG. 17 is a sectional view of an outer diameter heat shield according to another disclosed non-limiting embodiment.

With reference to FIG. 17, in another disclosed non-limiting embodiment, the heat shield 304 includes an outer diameter 420 with two bends 422, 424. The heat shield 304 extends toward the inner vane platform 72 to reduce a spacing between the heat shield and the inner vane platform 72 and reduce flow of core gas path flow "C" from within the core gas path 62 into the cavity 340. The heat shield 304 includes an outer diameter 430 with a press fit interface 432 against the outer diameter 580D of the bearing support to provide damping of the heat shield 304 and reduce vibratory stresses.

Figure 18:
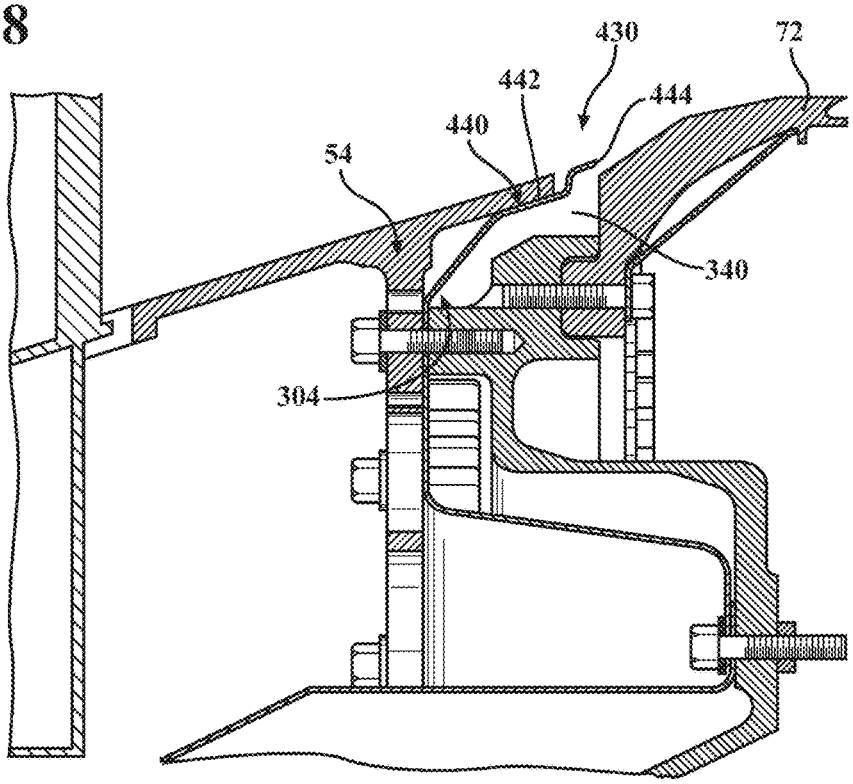
FIG. 18 is a sectional view of an outer diameter heat shield according to another disclosed non-limiting embodiment.

With reference to FIG. 18, in another disclosed non-limiting embodiment, the heat shield 304 includes an outer diameter 440 with a press fit interface 442 against the inlet duct 54 to provide damping of the heat shield 304 and reduce vibratory stress thereof. An aft edge 444 of the heat shield 304 extends aft of the inlet duct 54 toward the inner vane platform 72 to reduce flow of core gas path flow "C" from within the core gas path 62 into the cavity 340.

Figure 19:
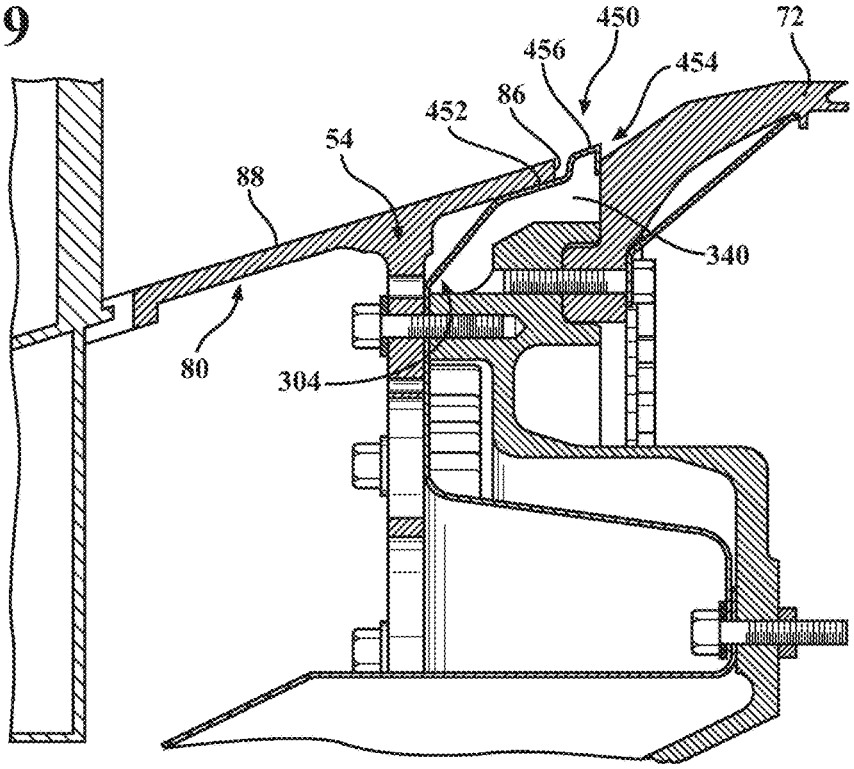
FIG. 19 is a sectional view of an outer diameter heat shield according to another disclosed non-limiting embodiment.
Figure 20:
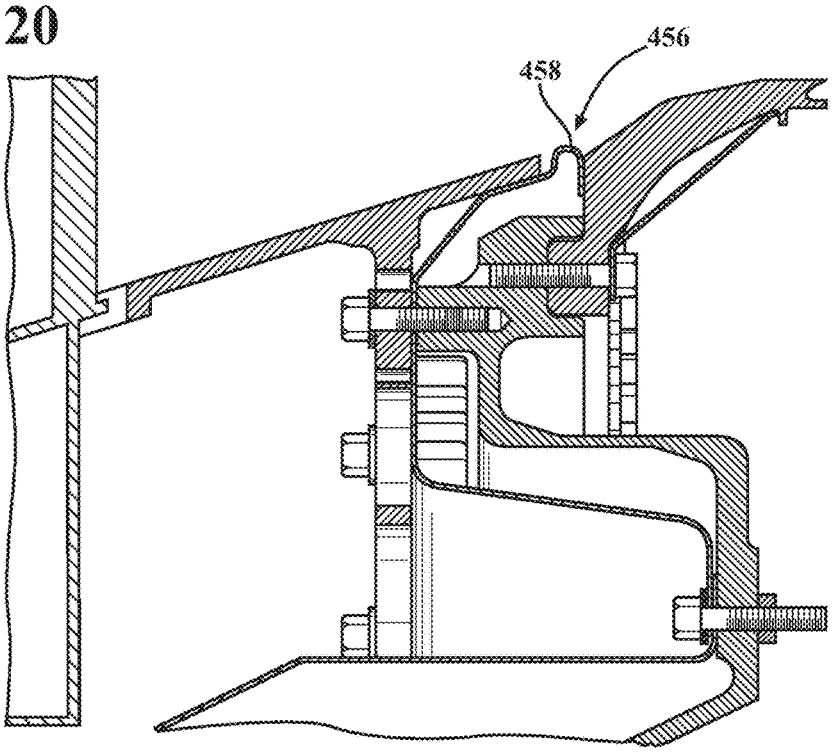
FIG. 20 is a sectional view of an outer diameter heat shield according to another disclosed non-limiting embodiment.

With reference to FIG. 19, in another disclosed non-limiting embodiment, the heat shield 304 includes an outer diameter 450 with a press fit interface 452 against the inlet duct 54 to provide damping of the heatshield 304 and reduce its vibratory stress. An aft end section 454 of the heat shield 304 extends aft of the inlet duct 54 and into contact with the inner vane platform 72 to reduce core gas path flow "C" from within the core gas path 62 into the cavity 340. The aft end section 454 of the heat shield 304 further forms a ramp surface 456 that essentially extends the inner surface 88 of the inlet duct 54. That is, the aft end section 454 of the heat shield 304 fills the gap between the aft edge 86 of the inlet duct 54 and the inner vane platform 72. FIG. 20 depicts an alternative ramp surface 456 of another embodiment of the heat shield 304 having an arcuate bend 457 that is contemplated to be relatively simpler to manufacture.

Figure 21:
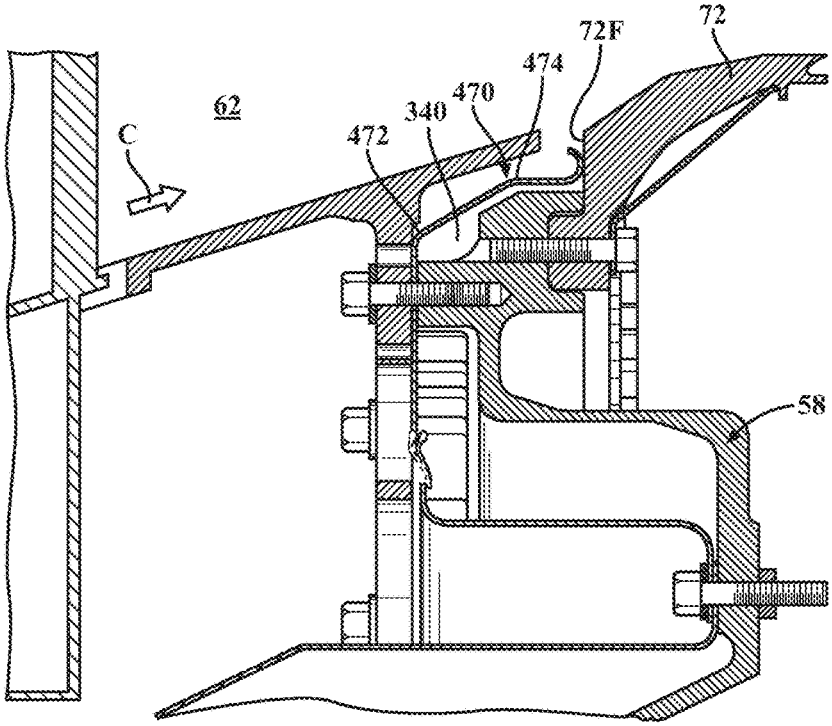
FIG. 21 is a sectional view of an outer diameter heat shield according to another disclosed non-limiting embodiment.

With reference to FIG. 21, in another disclosed non-limiting embodiment, the heat shield 304 includes an outer diameter 470 with two bends 472, 474 that extends into contact with a forward surface 72F of the inner vane platform 72 to reduce core gas path flow "C" from within the core gas path 62 into the cavity 340. This still further reduces direct contact between the bearing support 58 and the core gas path flow "C".

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed:

1. A power turbine section for a gas turbine engine comprising:

a bearing support;

an inlet duct at least partially supported by said bearing support;

a power turbine vane array disposed aft of said inlet duct and at least partially supported by said bearing support; and a heat shield assembly mounted to said bearing support, wherein said heat shield assembly forms an outer diameter disposed between said inlet duct and an inner vane platform of said power turbine vane array, said outer diameter directed toward said inner vane platform of said power turbine vane array, wherein heat shield assembly includes an outer heat shield with an inner portion, an outer portion separate from said inner portion, and a finger seal therebetween configured so that the inner portion and the outer portion partially overlap, said finger seal disposed radially between a first multiple of fastener apertures located at a first radial position and a second multiple of fastener apertures located at a second radial position different than the first radial position.

2. The power turbine section as recited in claim 1, wherein said heat shield assembly forms a conic shaped inner diameter between a first multiple of fastener apertures and a second multiple of fastener apertures.

3. The power turbine section as recited in claim 1, wherein said heat shield assembly forms an L-shaped inner diameter between a first multiple of fastener apertures and a second multiple of fastener apertures.

4. The power turbine section as recited in claim 1, wherein said heat shield assembly forms an S-shaped inner diameter between a first multiple of fastener apertures and a second multiple of fastener apertures.

5. The power turbine section as recited in claim 1, wherein said heat shield assembly forms a sine-wave shaped inner diameter between a first multiple of fastener apertures and a second multiple of fastener apertures.

6. The power turbine section as recited in claim 1, wherein said outer diameter includes more than one bend.

7. The power turbine section as recited in claim 1, wherein said outer diameter includes a press fit interface with an outer diameter of said bearing support.

8. The power turbine section as recited in claim 1, wherein said outer diameter includes a press fit interface with said inlet duct.

9. The power turbine section as recited in claim 8, wherein an aft end section of said heat shield assembly extends aft of said inlet duct.

10. The power turbine section as recited in claim 9, wherein said aft end section of said heat shield assembly fills a gap between an aft edge of said inlet duct and said inner vane platform.

11. The power turbine section as recited in claim 10, wherein said aft end section of said heat shield assembly forms a ramp surface that extends an inner surface of said inlet duct.

12. The power turbine section as recited in claim 10, wherein said aft end section of said heat shield assembly forms an arcuate bend within said gap.

13. The power turbine section as recited in claim 8, wherein an aft end section of said heat shield assembly extends aft of said inlet duct and into contact with said inner vane platform.

14. The power turbine section as recited in claim 13, wherein said aft end section of said heat shield assembly is displaced from said inlet duct.

15. The power turbine section as recited in claim 1, wherein said outer diameter of said heat shield assembly is directed toward and faces unobstructedly a leading edge of said inner vane platform of said power turbine vane array.

16. The power turbine section as recited in claim 1, wherein said heat shield assembly is fastened to said bearing support at two different radial locations.

17. A power turbine section for a gas turbine engine comprising:

an inlet case along an axis;

a power turbine vane array mounted to said inlet case;

a bearing support mounted to said power turbine vane array; and a heat shield assembly mounted to said bearing support, said heat shield assembly includes an inner heat shield and an outer heat shield, said inner heat shield and said outer heat shield being separate components, said outer heat shield including a first multiple of fastener apertures for coupling the outer heat shield to the bearing support at a first radial location and a second multiple of fastener apertures for coupling the outer heat shield to the bearing support at a second radial location different than said first radial location, said outer heat shield including an outer diameter radially outboard of said first multiple of fastener apertures, said outer diameter directed toward an inner vane platform of said power turbine vane array;

wherein at least one of said first multiple of fastener apertures and said second multiple of fastener apertures includes a slot therefrom.

18. The power turbine section as recited in claim 17, wherein said outer diameter includes a press fit interface with an outer diameter of said bearing support.

19. The power turbine section as recited in claim 17, wherein said outer diameter includes a press fit interface with an inlet duct, said inlet duct at least partially supported by said bearing support.

20. The power turbine section as recited in claim 17, wherein said outer diameter includes a press fit interface with said inner vane platform.

21. A power turbine section for a gas turbine engine comprising:

a bearing support;

an inlet duct at least partially supported by said bearing support;

a power turbine vane array disposed aft of said inlet duct and at least partially supported by said bearing support; and a heat shield assembly mounted to said bearing support, wherein said heat shield assembly forms an outer diameter disposed between said inlet duct and an inner vane platform of said power turbine vane array, said outer diameter directed toward said inner vane platform of said power turbine vane array;

wherein said outer diameter includes a press fit interface with said inlet duct.

* * * * *